US008708265B2

(12) United States Patent
Hendrix

(10) Patent No.: US 8,708,265 B2
(45) Date of Patent: Apr. 29, 2014

(54) ROLLER CRUSHER WITH BALANCING CYLINDERS

(75) Inventor: Robert Leh Hendrix, York, PA (US)

(73) Assignee: Metso Minerals Industries, Inc., Waukesha, WI (US)

( * ) Notice: Subject to any disclaimer, the term of this patent is extended or adjusted under 35 U.S.C. 154(b) by 70 days.

(21) Appl. No.: 13/451,909

(22) Filed: Apr. 20, 2012

(65) Prior Publication Data

US 2013/0277470 A1 Oct. 24, 2013

(51) Int. Cl.
*B02C 23/00* (2006.01)

(52) U.S. Cl.
USPC ..... 241/230; 241/231; 241/233; 241/234; 241/285.3; 241/292

(58) Field of Classification Search
USPC ..... 241/230, 232–234, 285.1, 285.3, 292
See application file for complete search history.

(56) References Cited

U.S. PATENT DOCUMENTS

| | | | | |
|---|---|---|---|---|
| 340,720 | A * | 4/1886 | Krom | 241/232 |
| 667,777 | A * | 2/1901 | Iler | 241/232 |
| 727,177 | A * | 5/1903 | Montgomery | 241/232 |
| 3,208,678 | A | 9/1965 | Pick et al. | |
| 3,899,965 | A * | 8/1975 | Koch et al. | 100/155 R |
| 3,970,256 | A * | 7/1976 | Ruegger et al. | 241/231 |
| 4,168,806 | A * | 9/1979 | Jakobs | 241/232 |
| 5,199,657 | A | 4/1993 | Kastingschafer et al. | |
| 5,263,651 | A | 11/1993 | Nadaraja | |
| 5,417,374 | A | 5/1995 | Kranz et al. | |
| 5,553,796 | A | 9/1996 | Bettenworth | |
| 5,568,896 | A | 10/1996 | Adams et al. | |
| 5,865,382 | A | 2/1999 | Bielagus | |
| 8,297,847 | B2 * | 10/2012 | Niklewski et al. | 384/432 |
| 2005/0199757 | A1 | 9/2005 | Sano | |
| 2010/0310702 | A1 | 12/2010 | Splinter | |
| 2011/0114772 | A1 | 5/2011 | Nickel | |

FOREIGN PATENT DOCUMENTS

| | | | |
|---|---|---|---|
| AT | 247212 | B | 5/1966 |
| DE | 27 04 243 | A1 | 8/1978 |
| EP | 2 214 898 | A1 | 8/2010 |
| WO | 98/08608 | A1 | 3/1998 |
| WO | 2011/051117 | A1 | 5/2011 |
| WO | 2011/131428 | A1 | 10/2011 |

OTHER PUBLICATIONS

European Search Report dated Apr. 19, 2013.

* cited by examiner

*Primary Examiner* — Faye Francis
*Assistant Examiner* — Leonel Vasquez
(74) *Attorney, Agent, or Firm* — Andrus Intellectual Property Law, LLP

(57) ABSTRACT

The present invention relates to a roller crusher having two generally parallel rotatable rollers separated by a gap, and a feeding arrangement for feeding material to the rollers. The roller crusher includes a base frame and a first and a second roller frame section, each of the first and second roller frames sections being pivotably connected to the base frame and arranged for carrying one of the rollers in bearings arranged at opposed ends of each roller. The roller crusher also includes at least one balancing cylinder extending between one of the roller frame sections and the base frame such that when the at least one balancing cylinder is activated, the interconnected roller frame sections will pivot relative to the base frame, thus adjusting the position of the rollers relative to the base frame.

15 Claims, 1 Drawing Sheet

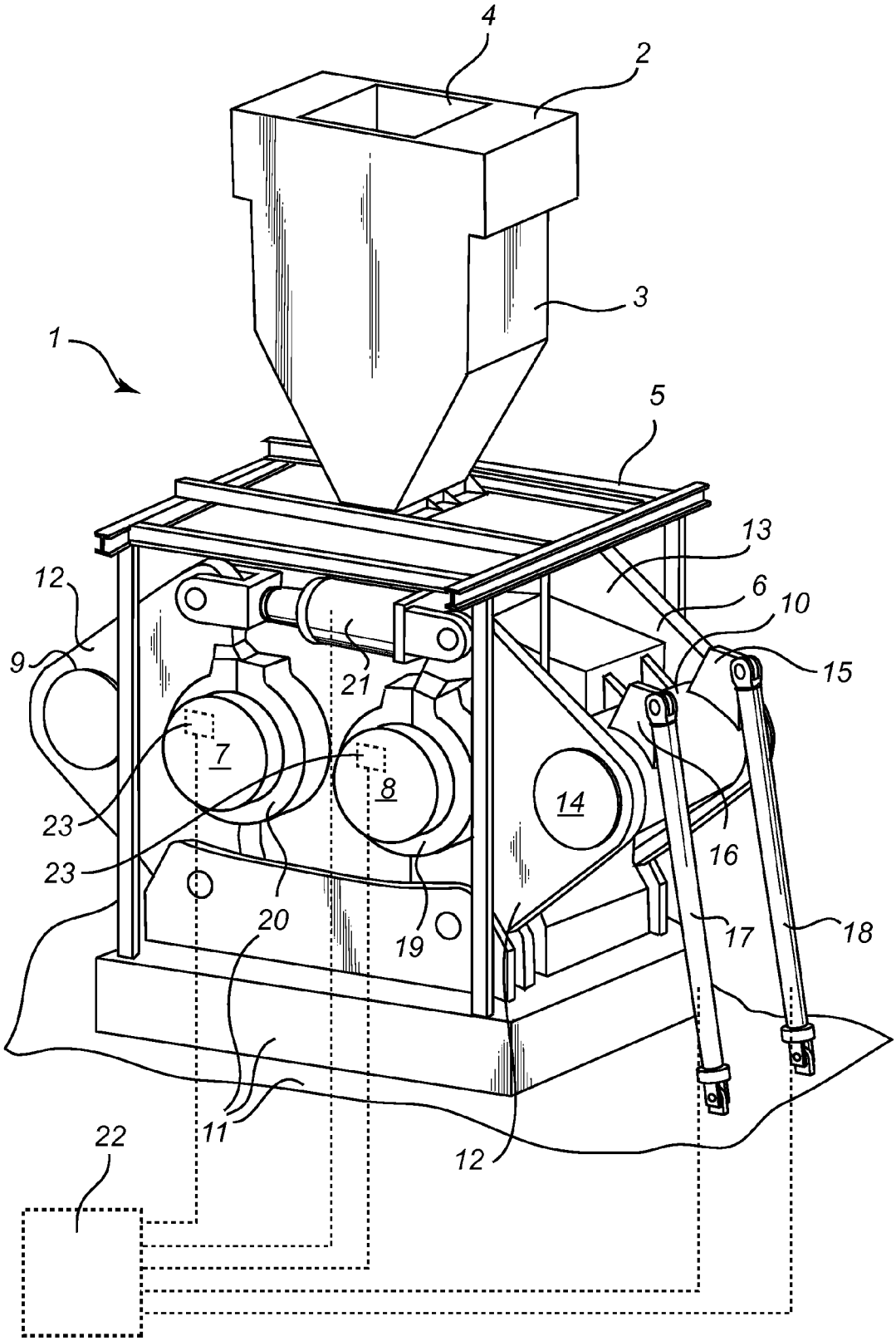
4
2
3
1
5
13
12
6
10
9
15
21
7
8
14
23
23
16
20
19
17
18
11
12
22

ROLLER CRUSHER WITH BALANCING CYLINDERS

FIELD OF THE INVENTION

The present invention relates to crushing device, especially a roller crusher where two, generally parallel rollers are separated by a gap and rotate in opposite directions.

BACKGROUND OF THE INVENTION

When crushing or grinding rock, ore, cement clinker and other hard materials, roller crushers may be used having two generally parallel rolls which rotate in opposite directions, towards each other, and which are separated by a gap. The material to be crushed is fed by gravity or choke-fed into the gap. One type of roller crusher is called high pressure grinding rollers or high pressure roller crushers. This type of roller crusher uses a crushing technique called interparticle crushing. Here, the material to be crushed or pulverised is crushed, not only by the crushing surface of the rolls, but also by particles in the material to be crushed, hence the name interparticle crushing. One example of a high pressure grinding roller is described in EP-2214898 where the gap width between the two rollers can be adjusted as well as the position within the frame of the rollers. The solution disclosed in that prior art is, however, complicated and include a very large number of hydraulic working chambers.

SUMMARY OF THE INVENTION

It is an object of the invention to provide a roller crusher which overcomes, or at least reduces the above mentioned problems, and allows a simple yet reliable adjustment of the position of the gap between the rollers relative a base frame. This object and other objects are solved by a roller crusher of the present invention.

Thus, in accordance with an aspect of the present invention, there is provided a roller crusher having two generally parallel rotatable rollers separated by a gap and a feeding arrangement for feeding material to said rollers. The roller crusher further comprises a base frame and a first and a second roller frame section, each of said first and second roller frame sections being pivotably connected to said base frame. The roller frames are each arranged for carrying one of said rollers in bearings arranged at opposed ends of said each roller. At least one balancing cylinder is arranged to extend between one of the roller frame sections and the base frame such that when the at least one balancing cylinder is activated, the interconnected roller frame sections will pivot relative to said base frame, thus adjusting the position of the rollers relative to said base frame. This is advantageous in that a desired centering of the rollers and the feeding arrangement in relation to each other may be achieved.

In an embodiment, the roller crusher further comprises at least one gap adjusting cylinder interconnecting said roller frame sections and is arranged to adjust the gap width between the rollers. The gap adjusting cylinder and the balancing cylinder can be activated independently from each other. This has the advantage that the position of the gap can be adjusted without affecting the width of the gap. Furthermore, the possibility of adjusting the position of the gap relative the base frame and thus relative the feeding arrangement is favourable since it avoids uneven wear and power draw on the rolls.

In accordance with an embodiment of the roller crusher, the feeding arrangement is fixedly mounted relative to the base frame. Since, according to the present invention, the position of the rollers can be adjusted relative to the base frame, the feeding arrangement can be fixedly mounted to the base frame which is a more robust and inexpensive solution than a movable mounting of the feeding arrangement.

In accordance with an embodiment of the roller crusher, each roller frame section comprises a front and a rear roller plate, said front and rear roller plates being interconnected by means of a spacer pipe extending substantially parallel with the rollers. The provision of a spacer pipe between two roller plates provides a very favourable weight/strength-ratio.

In accordance with an embodiment of the roller crusher, the bearings carrying each roller comprises a front bearing arranged at the front roller plate and a rear bearing arranged at the rear roller plate. This provides for a simple and reliable construction.

In accordance with an embodiment of the roller crusher, one gap adjusting cylinder interconnects the respective front roller plates of the first and second roller frame sections and another gap adjusting cylinder interconnects the respective rear roller plates of the first and second roller frame sections. This is a favourable construction which provides good leverage for the gap adjusting cylinders.

In accordance with an embodiment of the roller crusher, two balancing cylinders are arranged to extend between one of the roller frame sections and the base frame. By providing two balancing cylinders, torsional moments occurring during use of the roller crusher can be carried in a appropriate manner.

In accordance with an embodiment of the roller crusher, a Programmable Logic Controller (PLC) is arranged to monitor and adjust operating conditions of the roller crusher.

In accordance with an embodiment of the roller crusher, the PLC, during use of the roller crusher, is arranged to monitor the position of the centre of the gap between the rollers relative to a feed chute of the feeding arrangement and to adjust said position by activating at least one balancing cylinder in case of deviations of said position outside pre-set limits. This is very advantageous since unsymmetrical feeding of material to the rollers causes uneven wear and power consumption of the rollers.

In accordance with an embodiment of the roller crusher, a sensor arranged on one of the rollers is used to monitor the position of the centre of the gap between the rollers relative to the feed chute of the feeding arrangement. The sensor sends a signal to the PLC which in turn, if necessary, activates at least one balancing cylinder such that the centre of the gap and the feed chute are aligned.

In accordance with other embodiments of the roller crusher, the at least one gap adjusting cylinder and the at least one balancing cylinder comprise hydraulic cylinders and wherein separate hydraulic pumps are provided such that each cylinder can be adjusted independently. This is convenient to achieve a high degree of freedom when it comes to adjustments.

Other objectives, features and advantages of the present invention will appear from the following detailed disclosure, from the attached claims, as well as from the drawings. It is noted that the invention relates to all possible combinations of features.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated. As used herein, the term "comprising" and variations of that term are not intended to exclude other additives, components, integers or steps.

BRIEF DESCRIPTION OF THE DRAWINGS

FIG. 1 shows a schematic perspective view of an embodiment of the invention.

DESCRIPTION OF PREFERRED EMBODIMENTS

In an embodiment of a roller crusher of the invention, as shown in the figures, the roller crusher 1 comprises a feeding arrangement 2 comprising a feeder hopper 3 having an upwardly directed opening 4 into which material such as rock, ore, cement clinker or other crushable material can be supplied. The feeding arrangement 2 is fixedly mounted to beam construction 5 which in turn is fixedly mounted to the base frame 11. The base frame may be made in one piece, or in two or more pieces, fixed in relation to each other by attachment to a foundation. The roller crusher further comprises a roller frame 6 in which the rollers 7, 8 are carried in bearings (not shown in the figures). The roller frame 6 comprises two roller frame sections 9, 10 each of which is pivotally mounted to base frame 11 and comprises a front and a rear roller plate 12, 13 and a spacer pipe 14 extending generally parallel to the rollers 7, 8 and connecting the roller plates 12, 13. Using a pipe and two roller plates provides a good weight-to-strength ratio. The roller frame sections 9, 10 further comprises fastening hooks 15, 16 to which two balancing cylinders 17, 18 are attached with their upper ends. The lower ends of said balancing cylinders are attached to base frame 11. Alternatively, the lower ends of the balancing cylinders may be attached to the foundation. The bearings for the rollers 7, 8 are mounted in bearing caps 19, 20 provided in both the front and rear roller plates 12, 13. Even though only the bearing caps 19, 20 of the front roller plates 12 are shown in the figures, the skilled person easily understands that the rear roller plates 13 are provided with corresponding bearing caps. Gap adjustment cylinders 21 are attached to upper regions of the front roller plates 12 and correspondingly to the rear roller plates 13, only the front gap adjustment cylinder can be seen in the figures.

When the roller crusher according to the present invention is used, material to be crushed is fed into the opening 4 of the feeding arrangement 2. The material flows through the feeding arrangement 2, exits via the guiding plates (not shown) and arrives at the rollers 7, 8. A sensor 23 may be provided within the roller crusher, e.g. on one of the rollers 7, 8, for determining the position of the center of the gap between the rollers 7, 8 relative to the feeding arrangement 2. The sensor 23 sends a signal to a Programmable Logic Controller (PLC) 22 which determines if the position lies within a pre-set acceptable range. If the position of the gap lies outside of this range, the PLC 22 will send a signal activating the adjustment cylinders which will cause the roller frame sections 9, 10 to pivot around their connection to the base frame. This pivotal movement will re-position the frame sections 9, 10 and together with them the rollers 7, 8 until the gap between the rollers 7, 8 lies within the acceptable range relative to the feed chute. The centering of the gap relative to the feed chute is of great importance to avoid uneven wear of the rollers and power consumption of the rollers. This stands in contrast to prior art crushers where the feeding arrangement is moved relative to the rollers when the feeding of material is off-center.

Similarly, sensors will determine if the width of the gap lies within an acceptable range and if this is not the case, the PLC will activate one or both gap adjusting cylinders 21. Due to the fact that two, individually adjustable gap adjusting cylinders are provided, one at the front and one at the rear, the skew between the rollers 7, 8 can be adjusted as suitable. Hence, if an uneven load of material reaches the rollers 7, 8 this can be compensated for by means of the gap adjusting cylinders. Other parameters can also be monitored and compensated for, e.g. the pressure within the gap adjusting cylinders 21, rotational speed of the rollers, 7, 8, the flow of material through the feeding arrangement and many others which are obvious to the skilled person. By using a plurality of hydraulic pumps and a suitable number of relief valves, a high degree of independency between the different hydraulic cylinders can be obtained.

It should also be noted that a replacement or service of the rollers 7, 8 is facilitated by the construction of the roller crusher according to the present invention. Should maintenance or even replacement of the equipment be required, the adjustment cylinders are dismounted, thereafter the respective roller frame sections are pivoted outwardly to the respective sides. The balancing cylinders may provide support during this outward pivoting. Thereafter, access is easy for e.g. replacement of rollers or similar by simply hoisting the rollers upwardly. This stands in sharp contrast to many prior art crushers where dismantling of the equipment is labour intensive and complicated. Furthermore, it is apparent that the balancing cylinders 17, 18 do not necessarily have to be attached with their upper ends to the spacer pipe 14 being outwardly inclined. Instead, they could, for example, be attached with their upper ends to an outer surface of the front and rear roller plates 12, 13 of the roller frame section being inwardly inclined. This would provide for a more compact execution of the roller crusher 1.

The invention claimed is:

1. A roller crusher having two generally parallel rotatable rollers separated by a gap, and a feeding arrangement for feeding material to the gap between the said rollers, said roller crusher further comprising:

a base frame;

a first and a second roller frame section, each of said first and second roller frames sections being pivotably connected to said base frame and arranged for carrying one of said rollers in bearings arranged at opposed ends of said each roller; and at least one balancing cylinder arranged to extend between one of the roller frame sections and the base frame such that when the at least one balancing cylinder is activated, the interconnected roller frame sections will pivot relative to said base frame, thus adjusting the position of the gap between the rollers relative to said base frame and the feeding arrangement.

2. A roller crusher in accordance with claim 1, further comprising at least one gap adjusting cylinder interconnecting said roller frame sections and arranged to adjust the size of the gap between the rollers, wherein the at least one gap adjusting cylinder and the at least one balancing cylinder can be activated independently.

3. A roller crusher in accordance with claim 1, wherein the feeding arrangement is fixedly mounted relative to the base frame.

4. A roller crusher in accordance with claim 1, wherein each roller frame section comprises a front and a rear roller plate, said front and rear roller plates being interconnected by means of a spacer extending substantially parallel with the rollers.

5. A roller crusher in accordance with claim 4, wherein the bearings carrying each roller comprises a front bearing arranged at the front roller plate and a rear bearing arranged at the rear roller plate.

6. A roller crusher in accordance with claim 1, wherein two individually adjustable gap adjusting cylinders are provided at a distance from each other such that a skew between the rollers can be adjusted.

7. A roller crusher in accordance with claim 6, wherein one gap adjusting cylinder interconnects the respective front roller plates of the first and second roller frame sections and another gap adjusting cylinder interconnects the respective rear roller plates of the first and second roller frame sections.

8. A roller crusher in accordance with claim 1, wherein two balancing cylinders are arranged to extend between one of the roller frame sections and the base frame.

9. A roller crusher in accordance with claim 1, further comprising a Progammable Logic Controller (PLC) arranged to monitor and adjust operating conditions of the roller crusher.

10. A roller crusher in accordance with claim 9, comprising at least one sensor provided within the roll crusher to monitor the position of the center of the gap between the rollers relative to the feed chute of the feeding arrangement.

11. A roller crusher in accordance with claim 10, wherein the at least one gap adjusting cylinder and the at least one balancing cylinder comprise hydraulic cylinders and wherein separate hydraulic pumps are provided such that each cylinder can be adjusted independently.

12. A roller crusher in accordance with claim 10, wherein the PLC, during use of the roller crusher, is in communication with the at least one sensor and arranged to monitor the position of the center of the gap between the rollers relative to a feed chute of the feeding arrangement and to adjust said position by activating at least one balancing cylinder in case of deviations of said position outside pre-set limits.

13. A roll crusher having two generally parallel rotatable rollers separated by a crushing gap and a feeding arrangement for feeding material to the crushing gap between the rollers, the roll crusher further comprising:

a base frame;

a first roller frame section including a front roller plate and a rear roller plate, wherein each of the front and rear roller plates are pivotally connected to the base frame and are arranged for carrying one of the rollers;

a second roller frame section having a front roller plate and a rear roller plate, wherein each of the front and rear roller plates are pivotally connected to the base frame and arranged for carrying one of the rollers;

a pair of gap adjusting cylinders interconnecting the front roller plates of the pair of first and second roller frame sections and the rear roller plates of the pair of first and second roller frame sections, wherein the gap adjusting cylinders are arranged to adjust the size of the crushing gap between the rollers; and at least one balancing cylinder connected to one of the roller frame sections, wherein activation of the balancing cylinder pivots the first and second roller frame sections to adjust the position of the crushing gap relative to the base frame and the feeding arrangement.

14. The roll crusher of claim 13 wherein the gap adjusting cylinders are independently operable from the balancing cylinder.

15. The roll crusher of claim 13 wherein the feeding arrangement is fixed relative to the base frame.

* * * * *